US010718082B2

(12) United States Patent
Christensen et al.

(10) Patent No.: US 10,718,082 B2
(45) Date of Patent: Jul. 21, 2020

(54) ACOUSTIC HEAT EXCHANGER TREATMENT FOR A LAUNDRY APPLIANCE HAVING A HEAT PUMP SYSTEM

(71) Applicant: WHIRLPOOL CORPORATION, Benton Harbor, MI (US)

(72) Inventors: Mark J. Christensen, Stevensville, MI (US); John G. Kantz, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 206 days.

(21) Appl. No.: 15/674,753

(22) Filed: Aug. 11, 2017

(65) Prior Publication Data

US 2019/0048514 A1 Feb. 14, 2019

(51) Int. Cl.

| | |
|---|---|
| ***D06F 58/20*** | (2006.01) |
| ***D06F 58/02*** | (2006.01) |
| ***D06F 58/24*** | (2006.01) |
| ***F25B 30/02*** | (2006.01) |

(52) U.S. Cl.

CPC ..... *D06F 58/206* (2013.01); *D06F 58/02* (2013.01); *D06F 58/20* (2013.01); *D06F 58/24* (2013.01); *F25B 30/02* (2013.01); *F25B 2500/12* (2013.01); *F25B 2500/13* (2013.01)

(58) Field of Classification Search

CPC ..... D06F 58/206; D06F 58/02; D06F 58/24; D06F 58/20; F25B 30/02; F25B 2500/13; F25B 2500/12

See application file for complete search history.

(56) References Cited

U.S. PATENT DOCUMENTS

| | | | |
|---|---|---|---|
| 2,515,825 | A | 7/1950 | Grant |
| 2,873,041 | A | 2/1959 | Allen |
| 2,934,023 | A | 4/1960 | Lamkin et al. |
| 3,196,553 | A | 7/1965 | Deaton et al. |
| 3,218,730 | A | 11/1965 | Menk et al. |
| 3,342,961 | A | 9/1967 | Deaton et al. |
| 3,653,807 | A | 4/1972 | Platt |
| 3,805,404 | A | 4/1974 | Gould |
| 3,953,146 | A | 4/1976 | Sowards |
| 3,999,304 | A | 12/1976 | Doty |

(Continued)

FOREIGN PATENT DOCUMENTS

| | | | |
|---|---|---|---|
| CN | 101967746 | A | 2/2011 |
| CN | 105177914 | A | 12/2015 |

(Continued)

*Primary Examiner* — David J Laux
(74) *Attorney, Agent, or Firm* — Price Heneveld LLP

(57) ABSTRACT

A laundry appliance includes a rotating drum for processing laundry. A heat pump system has a heat exchanger that is positioned within an air conditioning chamber. A blower directs process air through an air path that includes the rotating drum and the air conditioning chamber. An insulating member positioned between a top portion of the heat exchanger and an underside of a cover member for the air conditioning chamber. The insulating member directs the process air through the heat exchanger and away from the underside of the cover member and absorbs sound and vibration generated by movement of process air through the heat exchanger.

20 Claims, 6 Drawing Sheets

(56) References Cited

U.S. PATENT DOCUMENTS 4,134,518 A 1/1979 Menchen
4,137,647 A 2/1979 Clark, Jr.
4,260,876 A 4/1981 Hochheiser
4,261,179 A 4/1981 Dageford
4,860,921 A 8/1989 Gidseg
4,870,735 A 10/1989 Jahr, Jr. et al.
5,285,664 A 2/1994 Chang et al.
5,600,966 A 2/1997 Valence et al.
5,628,122 A 5/1997 Spinardi
5,666,817 A 9/1997 Schulak et al.
5,720,536 A 2/1998 Jenkins et al.
5,927,095 A 7/1999 Lee
5,946,934 A 9/1999 Kim et al.
5,979,174 A 11/1999 Kim et al.
6,041,606 A 3/2000 Kim
6,073,458 A 6/2000 Kim
6,401,482 B1 6/2002 Lee et al.
6,598,410 B2 7/2003 Temmyo et al.
6,793,010 B1 9/2004 Manole
6,957,501 B2 10/2005 Park et al.
6,966,124 B2 * 11/2005 Ryu ..... D06F 25/00 34/131
6,973,799 B2 12/2005 Kuehl et al.
6,983,615 B2 1/2006 Winders et al.
7,008,032 B2 3/2006 Chekal et al.
7,055,262 B2 6/2006 Goldberg et al.
7,093,453 B2 8/2006 Asan et al.
7,117,612 B2 10/2006 Slutsky et al.
7,127,904 B2 10/2006 Schmid
7,143,605 B2 12/2006 Rohrer et al.
7,162,812 B2 1/2007 Cimetta et al.
7,181,921 B2 2/2007 Nuiding
7,207,181 B2 4/2007 Murray et al.
7,254,960 B2 8/2007 Schmid et al.
7,504,784 B2 3/2009 Asada et al.
7,610,773 B2 11/2009 Rafalovich et al.
7,624,514 B2 12/2009 Konabe et al.
7,665,225 B2 2/2010 Goldberg et al.
7,707,860 B2 5/2010 Hong et al.
7,775,065 B2 8/2010 Ouseph et al.
7,866,057 B2 1/2011 Grunert et al.
7,895,771 B2 3/2011 Prajescu et al.
7,934,695 B2 5/2011 Sim et al.
7,980,093 B2 7/2011 Kuehl et al.
8,024,948 B2 9/2011 Kitamura et al.
8,056,254 B2 11/2011 Loffler et al.
8,074,469 B2 12/2011 Hamel et al.
8,079,157 B2 12/2011 Balerdi Azpilicueta et al.
8,099,975 B2 1/2012 Rafalovich et al.
8,104,191 B2 1/2012 Ricklefs et al.
8,166,669 B2 5/2012 Park et al.
8,182,612 B2 5/2012 Grunert
8,240,064 B2 8/2012 Steffens
8,245,347 B2 8/2012 Goldberg et al.
8,266,813 B2 9/2012 Grunert et al.
8,266,824 B2 9/2012 Steiner
8,276,293 B2 10/2012 Ricklefs et al.
8,377,224 B2 2/2013 Grunert
8,382,887 B1 2/2013 Alsaffar
8,434,317 B2 5/2013 Besore
8,438,750 B2 5/2013 Dittmer et al.
8,484,862 B2 7/2013 Nawrot et al.
8,572,862 B2 11/2013 TeGrotenhuis
8,601,830 B2 12/2013 Lee et al.
8,615,895 B2 12/2013 Shin et al.
8,656,604 B2 2/2014 Ediger et al.
8,667,705 B2 3/2014 Shin et al.
8,695,230 B2 4/2014 Noh et al.
8,770,682 B2 7/2014 Lee et al.
8,789,287 B2 7/2014 Kim et al.
8,789,290 B2 7/2014 Grunert
8,857,071 B2 10/2014 Lee et al.
8,910,394 B2 12/2014 Steffens
8,915,104 B2 12/2014 Beihoff et al.
8,984,767 B2 3/2015 Grunert et al.
9,010,145 B2 4/2015 Lim et al.
9,022,228 B2 5/2015 Grunert
9,027,256 B2 5/2015 Kim et al.
9,027,371 B2 5/2015 Beihoff et al.
9,052,142 B2 6/2015 Kim et al.
9,062,410 B2 6/2015 Ahn et al.
9,085,843 B2 7/2015 Doh et al.
9,103,569 B2 8/2015 Cur et al.
9,134,067 B2 9/2015 Ahn et al.
9,140,472 B2 9/2015 Shin et al.
9,140,481 B2 9/2015 Cur et al.
9,212,450 B2 12/2015 Grunert et al.
9,249,538 B2 2/2016 Bison et al.
9,299,332 B2 3/2016 Je
9,303,882 B2 4/2016 Hancock
9,328,448 B2 5/2016 Doh et al.
9,328,449 B2 5/2016 Doh et al.
9,334,601 B2 5/2016 Doh et al.
9,335,095 B2 5/2016 Bison et al.
9,356,542 B2 5/2016 Ragogna et al.
9,359,714 B2 6/2016 Contarini et al.
9,372,031 B2 6/2016 Contarini et al.
9,435,069 B2 9/2016 Contarini et al.
9,487,910 B2 11/2016 Huang et al.
9,506,689 B2 11/2016 Carbajal et al.
9,534,329 B2 1/2017 Contarini et al.
9,534,340 B2 1/2017 Cavarretta et al.
9,605,375 B2 3/2017 Frank et al.
9,644,306 B2 5/2017 Doh et al.
9,663,894 B2 5/2017 Kim et al.
2004/0139757 A1 7/2004 Kuehl et al.
2005/0217139 A1 10/2005 Hong
2005/0229614 A1 10/2005 Ansted
2006/0070385 A1 4/2006 Narayanamurthy et al.
2006/0144076 A1 7/2006 Daddis, Jr. et al.
2006/0196217 A1 9/2006 Duarte et al.
2007/0033962 A1 2/2007 Kang et al.
2008/0141699 A1 6/2008 Rafalovich et al.
2008/0196266 A1 8/2008 Jung et al.
2008/0307823 A1 12/2008 Lee et al.
2009/0071032 A1 3/2009 Kreutzfeldt et al.
2009/0158767 A1 6/2009 McMillin
2009/0158768 A1 6/2009 Rafalovich et al.
2009/0165491 A1 7/2009 Rafalovich et al.
2009/0260371 A1 10/2009 Kuehl et al.
2009/0266089 A1 10/2009 Haussmann
2010/0011608 A1 1/2010 Grunert et al.
2010/0101606 A1 4/2010 Grunert
2010/0107703 A1 5/2010 Hisano et al.
2010/0146809 A1 6/2010 Grunert et al.
2010/0154240 A1 6/2010 Grunert
2010/0212368 A1 8/2010 Kim et al.
2010/0230081 A1 9/2010 Becnel et al.
2010/0258275 A1 10/2010 Koenig et al.
2010/0288471 A1 11/2010 Summerer
2011/0011119 A1 1/2011 Kuehl et al.
2011/0030238 A1 2/2011 Nawrot et al.
2011/0036556 A1 2/2011 Bison et al.
2011/0072849 A1 3/2011 Kuehl et al.
2011/0209484 A1 9/2011 Krausch et al.
2011/0209860 A1 9/2011 Koenig et al.
2011/0277334 A1 11/2011 Lee et al.
2011/0280736 A1 11/2011 Lee et al.
2012/0017456 A1 1/2012 Grunert
2012/0266627 A1 10/2012 Lee
2012/0272689 A1 11/2012 Elger et al.
2013/0008049 A1 1/2013 Patil
2013/0104946 A1 5/2013 Grunert et al.
2013/0111941 A1 5/2013 Yu et al.
2013/0160479 A1 * 6/2013 Webster ..... F16M 7/00 62/324.1
2013/0212894 A1 8/2013 Kim et al.
2013/0255094 A1 10/2013 Bommels et al.
2013/0263630 A1 10/2013 Doh et al.
2013/0276327 A1 10/2013 Doh et al.
2013/0318813 A1 12/2013 Hong et al.
2013/0340797 A1 12/2013 Bommels et al.
2014/0020260 A1 1/2014 Carow et al.
2014/0026433 A1 1/2014 Bison et al.

(56) References Cited

U.S. PATENT DOCUMENTS

| | | | |
|---|---|---|---|
| 2014/0075682 | A1 | 3/2014 | Filippetti et al. |
| 2014/0109428 | A1 | 4/2014 | Kim et al. |
| 2014/0190032 | A1 | 7/2014 | Lee et al. |
| 2014/0216706 | A1 | 8/2014 | Melton et al. |
| 2014/0260356 | A1 | 9/2014 | Wu |
| 2014/0290091 | A1 | 10/2014 | Bison et al. |
| 2014/0366397 | A1 | 12/2014 | Wakizaka et al. |
| 2015/0015133 | A1 | 1/2015 | Carbajal et al. |
| 2015/0033806 | A1 | 2/2015 | Cerrato et al. |
| 2015/0114600 | A1 | 4/2015 | Chen et al. |
| 2015/0285551 | A1 | 10/2015 | Aiken et al. |
| 2015/0308034 | A1 | 10/2015 | Cavarretta et al. |
| 2015/0322618 | A1 | 11/2015 | Bisaro et al. |
| 2016/0010271 | A1 | 1/2016 | Shin et al. |
| 2016/0040350 | A1 | 2/2016 | Xu et al. |
| 2016/0083894 | A1 | 3/2016 | Bison et al. |
| 2016/0083896 | A1 | 3/2016 | Ryoo et al. |
| 2016/0115636 | A1 | 4/2016 | Kim et al. |
| 2016/0115639 | A1 | 4/2016 | Kim et al. |
| 2016/0138208 | A1 | 5/2016 | Bison et al. |
| 2016/0138209 | A1 | 5/2016 | Kitayama et al. |
| 2016/0145793 | A1 | 5/2016 | Ryoo et al. |
| 2016/0169540 | A1 | 6/2016 | Hancock |
| 2016/0178267 | A1 | 6/2016 | Hao et al. |
| 2016/0186374 | A1 | 6/2016 | Ryoo et al. |
| 2016/0258671 | A1 | 9/2016 | Allard et al. |
| 2016/0265833 | A1 | 9/2016 | Yoon et al. |
| 2016/0282032 | A1 | 9/2016 | Gomes et al. |
| 2016/0290702 | A1 | 10/2016 | Sexton et al. |
| 2016/0305696 | A1 | 10/2016 | Kobayashi et al. |
| 2016/0348957 | A1 | 12/2016 | Hitzelberger et al. |
| 2018/0163340 | A1* | 6/2018 | Lee ..... D06F 58/20 |

FOREIGN PATENT DOCUMENTS

| | | | |
|---|---|---|---|
| CN | 105696291 | A | 6/2016 |
| DE | 3147796 | | 3/1983 |
| DE | 3738031 | A1 | 5/1989 |
| DE | 4304372 | A1 | 8/1994 |
| DE | 4409607 | A1 | 10/1994 |
| DE | 10002742 | C1 | 6/2001 |
| DE | 10116238 | B4 | 3/2005 |
| DE | 10002743 | B4 | 1/2006 |
| DE | 102005041145 | A1 | 3/2007 |
| DE | 102006018469 | A1 | 10/2007 |
| DE | 102007010272 | | 9/2008 |
| DE | 102007052835 | A1 | 5/2009 |
| DE | 102008033388 | A1 | 1/2010 |
| DE | 102008054832 | A1 | 7/2010 |
| DE | 102009046921 | | 5/2011 |
| DE | 102012223777 | A1 | 6/2014 |
| DE | 112012006737 | T5 | 4/2015 |
| EP | 468573 | A1 | 1/1992 |
| EP | 0816549 | A2 | 1/1998 |
| EP | 999302 | A1 | 5/2000 |
| EP | 1055767 | A1 | 11/2000 |
| EP | 1987190 | A1 | 11/2008 |
| EP | 2134896 | B1 | 12/2009 |
| EP | 2189568 | A1 | 5/2010 |
| EP | 2202349 | | 6/2010 |
| EP | 2284310 | A1 | 2/2011 |
| EP | 2324152 | B1 | 5/2011 |
| EP | 2341178 | A1 | 7/2011 |
| EP | 2386679 | | 11/2011 |
| EP | 2455526 | A1 | 5/2012 |
| EP | 2466001 | A1 | 6/2012 |
| EP | 2497856 | A1 | 9/2012 |
| EP | 2559805 | A1 | 2/2013 |
| EP | 2581489 | A1 | 4/2013 |
| EP | 2612964 | A1 | 7/2013 |
| EP | 2612965 | A1 | 7/2013 |
| EP | 2612966 | A1 | 7/2013 |
| EP | 2634301 | A1 | 9/2013 |
| EP | 2708636 | A1 | 3/2014 |
| EP | 2708639 | A1 | 3/2014 |
| EP | 2733257 | A1 | 5/2014 |
| EP | 2746455 | A1 | 6/2014 |
| EP | 2594687 | B1 | 9/2014 |
| EP | 2966215 | | 1/2016 |
| EP | 2993427 | A1 | 3/2016 |
| EP | 3015594 | A1 | 5/2016 |
| EP | 2468949 | B1 | 6/2016 |
| EP | 3034675 | A1 | 6/2016 |
| EP | 3241944 | | 11/2017 |
| GB | 2087029 | A | 5/1982 |
| JP | 2000018796 | | 1/2000 |
| JP | 2004053055 | | 2/2004 |
| JP | 2005027768 | | 2/2005 |
| JP | 2006017338 | | 1/2006 |
| JP | 2006187449 | | 7/2006 |
| JP | 2013019623 | A | 1/2013 |
| JP | 2013085687 | | 5/2013 |
| KR | 20100031929 | A | 3/2010 |
| NL | 7801958 | A | 8/1979 |
| WO | 8602149 | | 4/1986 |
| WO | 2004106737 | A1 | 12/2004 |
| WO | 2005001357 | A1 | 1/2005 |
| WO | 2005032322 | A2 | 4/2005 |
| WO | 2007013327 | A1 | 2/2007 |
| WO | 2007093461 | A1 | 8/2007 |
| WO | 2008077708 | A1 | 7/2008 |
| WO | 2008110451 | A1 | 9/2008 |
| WO | 2008151938 | A1 | 12/2008 |
| WO | 2009031812 | A2 | 3/2009 |
| WO | 2009059874 | A1 | 5/2009 |
| WO | 2009077226 | A1 | 6/2009 |
| WO | 2009077227 | A1 | 6/2009 |
| WO | 2009077291 | A1 | 6/2009 |
| WO | 2009089460 | A2 | 7/2009 |
| WO | 2010028992 | A1 | 3/2010 |
| WO | 2010040635 | A1 | 4/2010 |
| WO | 2010071355 | A2 | 6/2010 |
| WO | 2010102892 | A1 | 9/2010 |
| WO | 2010112321 | A1 | 10/2010 |
| WO | 2010118939 | A1 | 10/2010 |
| WO | 2011057954 | A2 | 5/2011 |
| WO | 2011061068 | A1 | 5/2011 |
| WO | 2012022803 | A1 | 2/2012 |
| WO | 2012065916 | A1 | 5/2012 |
| WO | 2012093059 | A1 | 7/2012 |
| WO | 2012101028 | A1 | 8/2012 |
| WO | 2012134149 | A2 | 10/2012 |
| WO | 2012138136 | A2 | 10/2012 |
| WO | 2013129779 | A1 | 9/2013 |
| WO | 2013144763 | A2 | 10/2013 |
| WO | 2013144764 | A1 | 10/2013 |
| WO | 2014001950 | A1 | 1/2014 |
| WO | 2014040923 | A1 | 3/2014 |
| WO | 2014041097 | A1 | 3/2014 |
| WO | 2014076149 | A1 | 5/2014 |
| WO | 2014095790 | A1 | 6/2014 |
| WO | 2014102073 | A1 | 7/2014 |
| WO | 2014102144 | A1 | 7/2014 |
| WO | 2014102317 | A2 | 7/2014 |
| WO | 2014102322 | A1 | 7/2014 |
| WO | 2014154278 | A1 | 10/2014 |
| WO | 2015003742 | A1 | 1/2015 |
| WO | 2015028270 | A1 | 3/2015 |
| WO | 2015074837 | A1 | 5/2015 |
| WO | 2015082011 | A1 | 6/2015 |
| WO | 2015101386 | A1 | 7/2015 |
| WO | 2015101387 | A1 | 7/2015 |
| WO | 2015101388 | A1 | 7/2015 |
| WO | 2015101892 | A1 | 7/2015 |
| WO | 2015160172 | A1 | 10/2015 |
| WO | 2015189129 | | 12/2015 |
| WO | 2016006900 | A1 | 1/2016 |
| WO | 2016020852 | A1 | 2/2016 |
| WO | 2016085432 | | 6/2016 |
| WO | 2016095970 | | 6/2016 |
| WO | 2016150660 | A1 | 9/2016 |

* cited by examiner

ACOUSTIC HEAT EXCHANGER TREATMENT FOR A LAUNDRY APPLIANCE HAVING A HEAT PUMP SYSTEM

FIELD OF THE DEVICE

The device is in the field of laundry appliances, and more specifically, a laundry appliance having a heat pump system that includes a heat exchanger, where an acoustical treatment is applied to a surface of the heat exchanger for dampening vibration and noise.

SUMMARY

In at least one aspect, a laundry appliance includes a rotating drum for processing laundry. A heat pump system has a heat exchanger that is positioned within an air conditioning chamber. A blower directs process air through an air path that includes the rotating drum and the air conditioning chamber. An insulating member is positioned between a top portion of the heat exchanger and an underside of a cover member for the air conditioning chamber. The insulating member directs the process air through the heat exchanger and away from the underside of the cover member and absorbs sound and vibration generated by movement of process air through the heat exchanger.

In at least another aspect, a heat exchange system for a heat pump appliance includes a blower that directs process air through an air path that includes a rotating drum. A heat pump system has an evaporator positioned within the air path for dehumidifying the process air, wherein a top portion of the evaporator is separated from an inside surface of the air path by a gap. An insulating member occupies the gap and engages the top portion of the evaporator and the inside surface of the air path, wherein the insulating member directs the process air away from the gap and into the evaporator.

In at least another aspect, a heat exchange system for a heat pump appliance includes a blower that directs process air through an air path that includes a rotating drum and a heat exchange cavity. A heat pump system has an evaporator and a condenser positioned within the heat exchange cavity for dehumidifying and heating the process air, respectively. An acoustical damper is compressed within a gap defined between top surfaces of the evaporator and the condenser and an interior surface of the heat exchange cavity. The acoustical damper directs the process air away from the gap and into the evaporator and also absorbs sound generated by movement of the process air through the evaporator and the condenser.

These and other features, advantages, and objects of the present device will be further understood and appreciated by those skilled in the art upon studying the following specification, claims, and appended drawings.

DETAILED DESCRIPTION OF EMBODIMENTS

Figure 1:
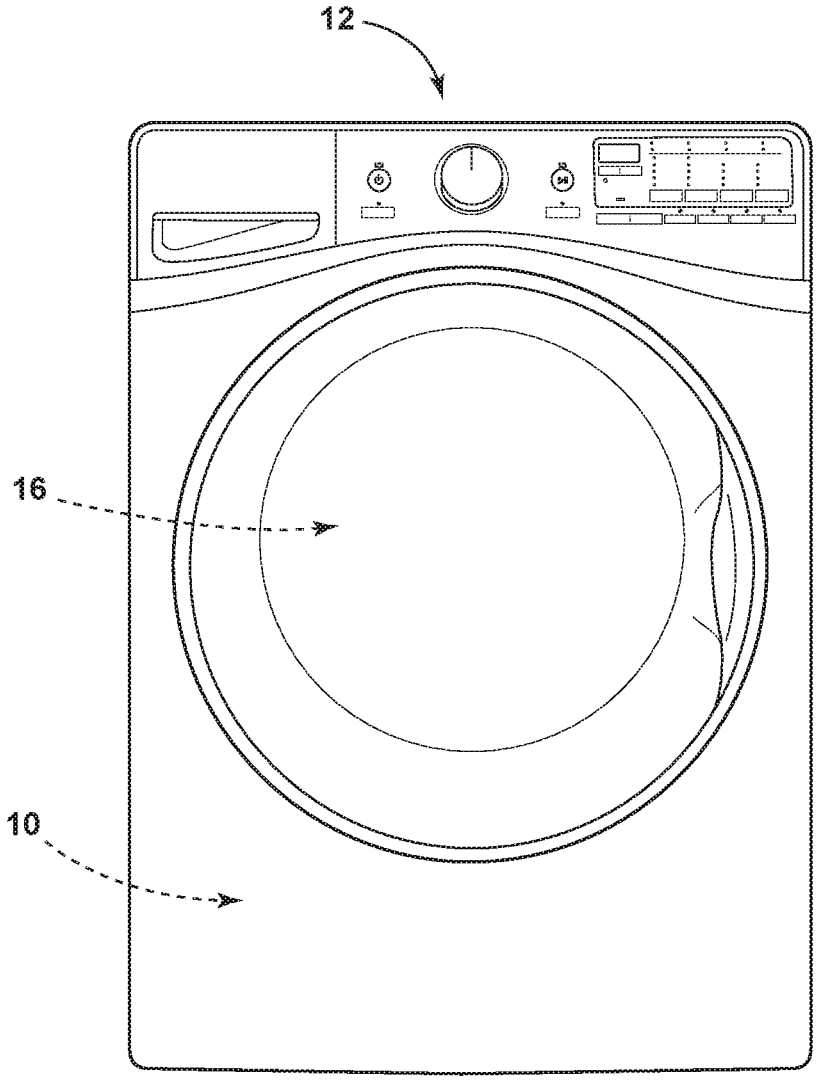
FIG. 1 is a front elevational view of a laundry appliance including a heat pump system and an aspect of the insulating material incorporated therein.
Figure 2:
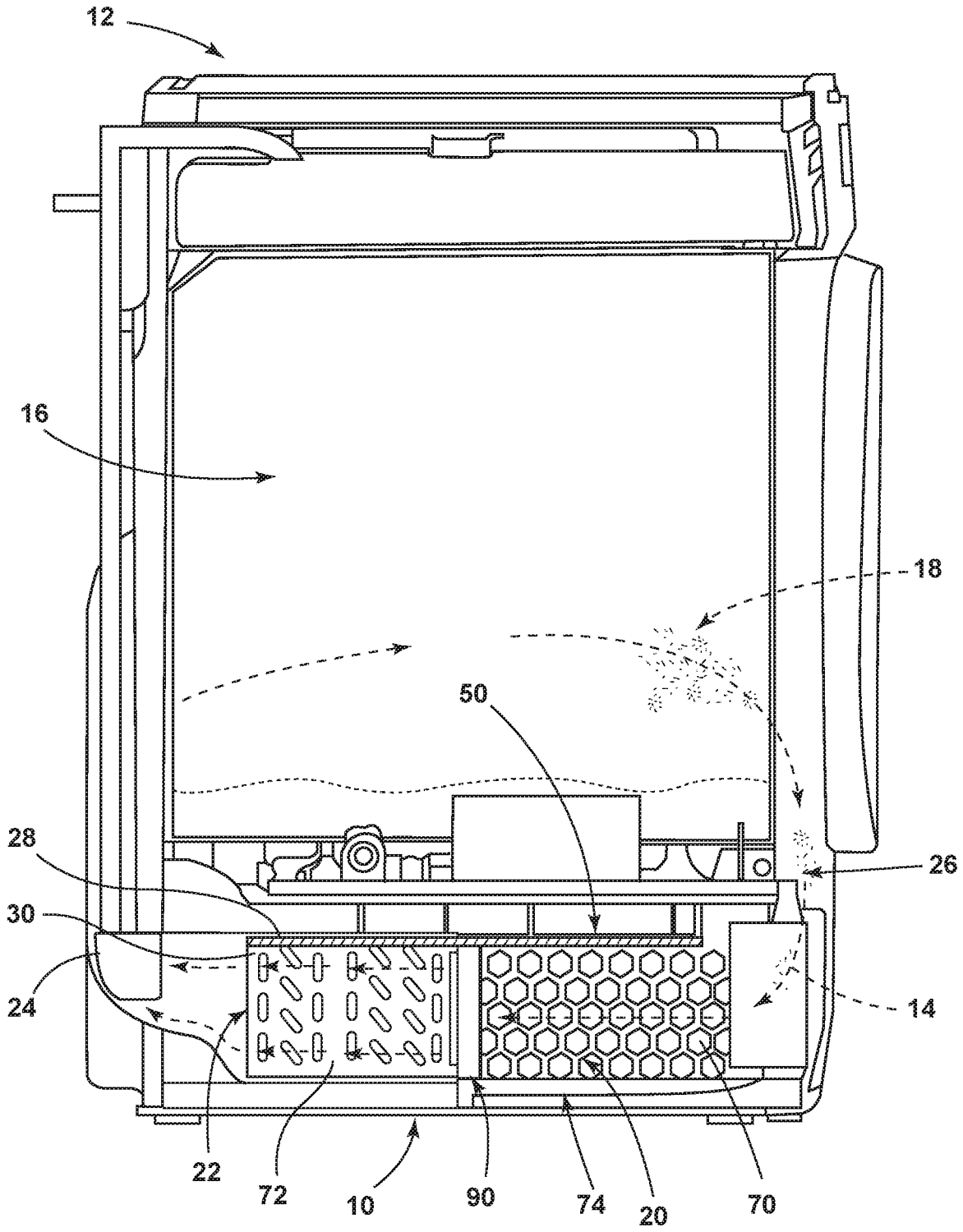
FIG. 2 is a cross-sectional view of the appliance of FIG. 1 taken along line II-II.
Figure 3:
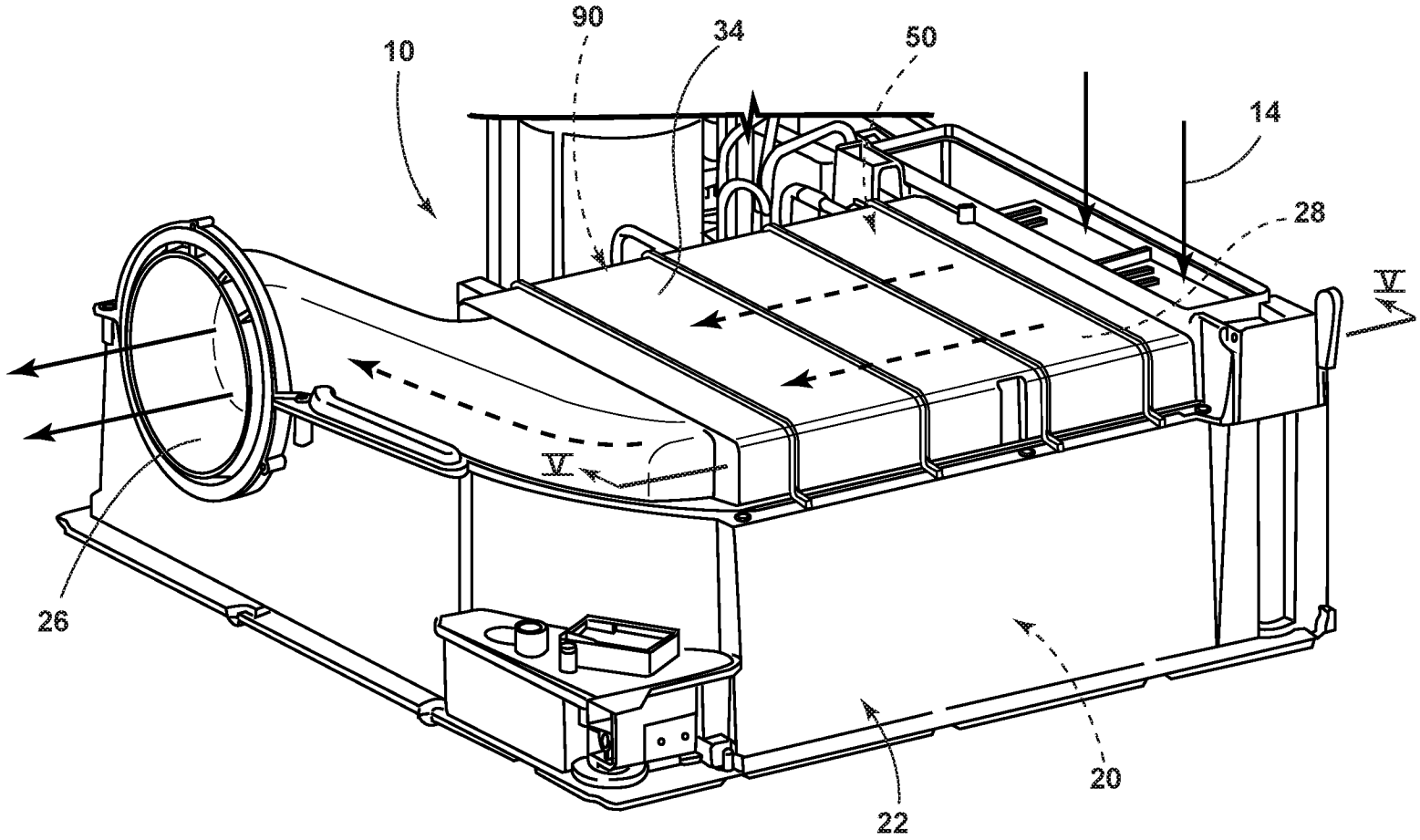
FIG. 3 is a top perspective view of a basement for a heat pump appliance incorporating an aspect of the insulating material.
Figure 4:
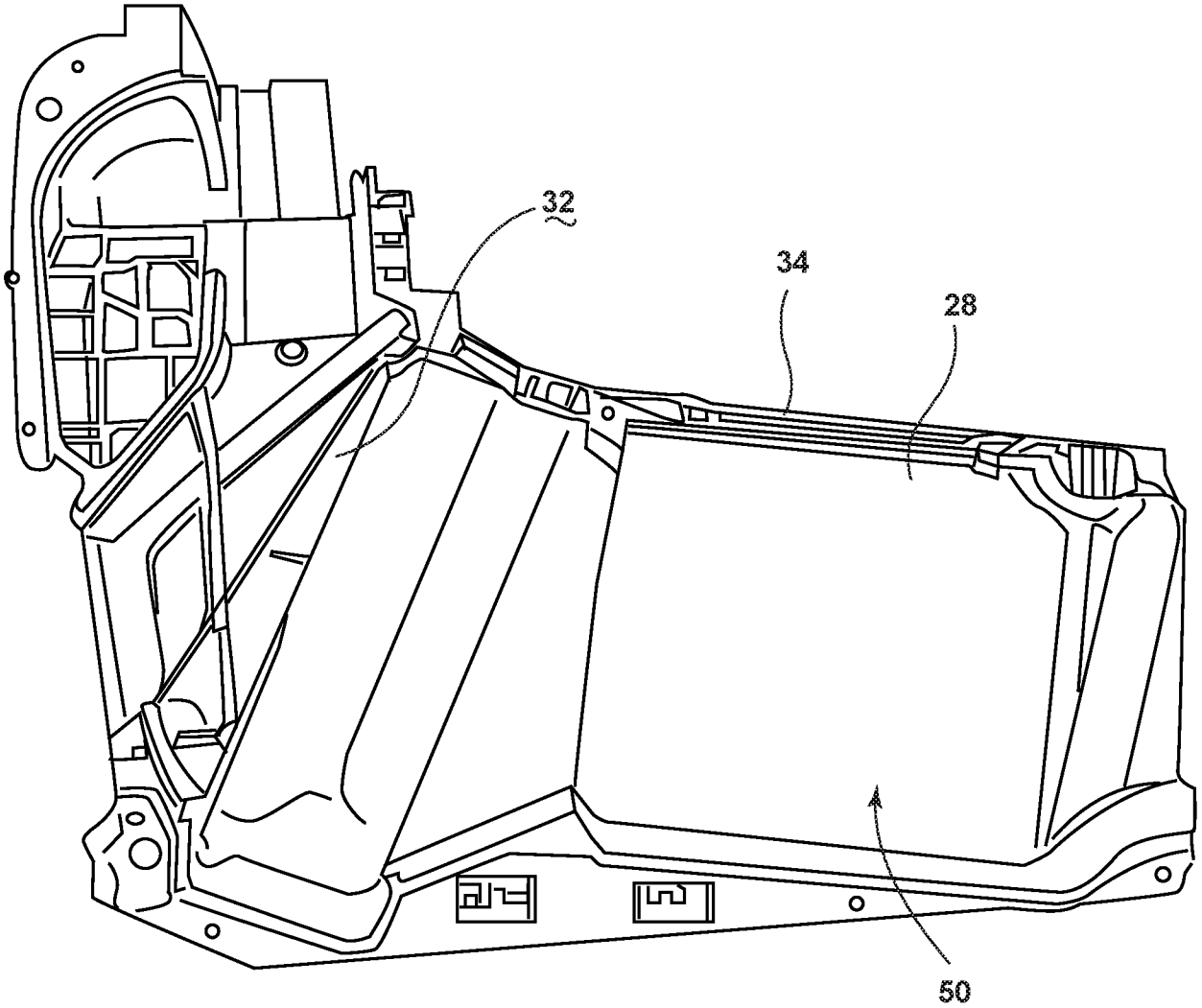
FIG. 4 is a bottom plan view of a cover member for an air conditioning chamber of a heat pump appliance that covers at least one heat exchanger.
Figure 5:
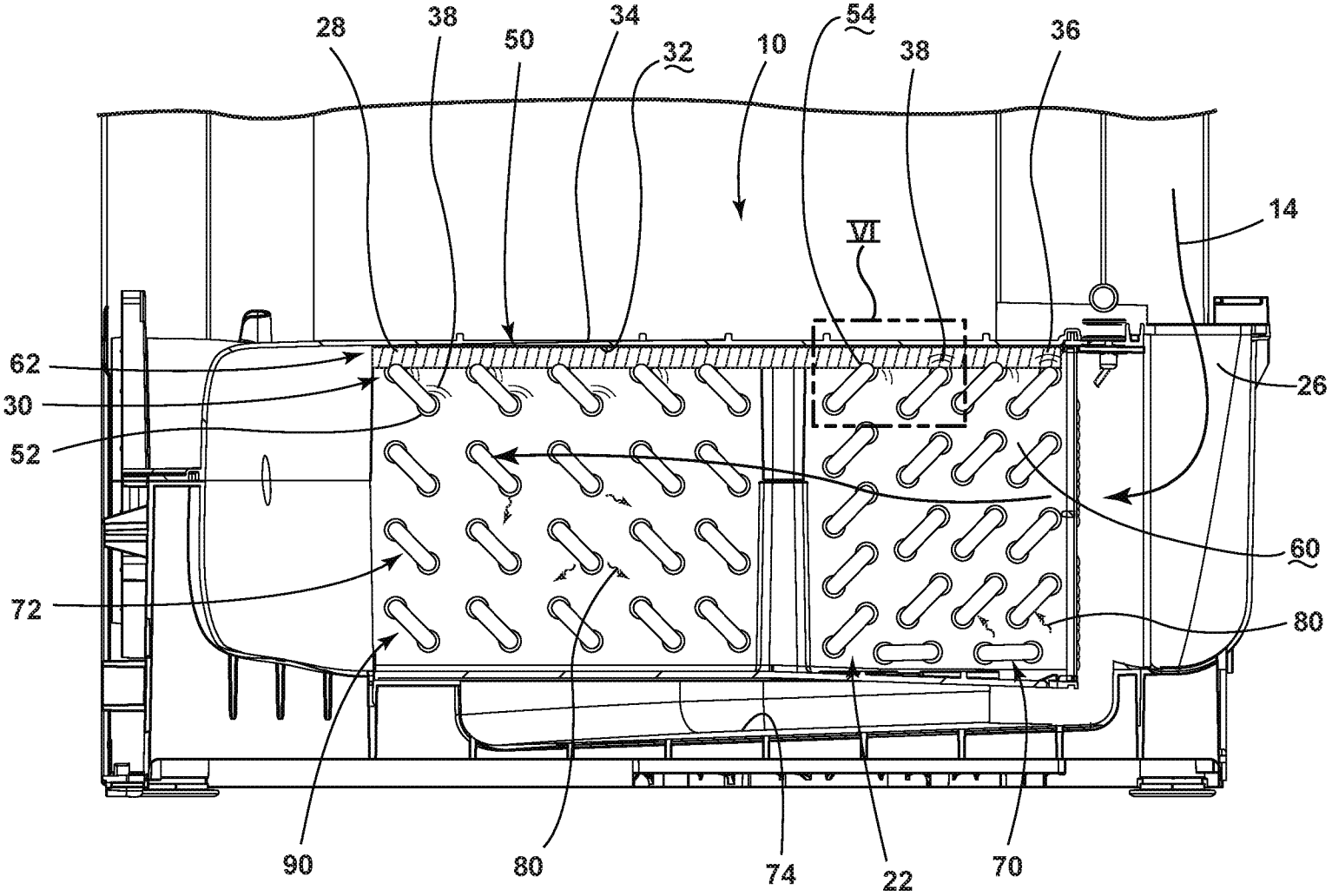
FIG. 5 is a cross-sectional view of the appliance basement of FIG. 3 taken along line V-V.
Figure 6:
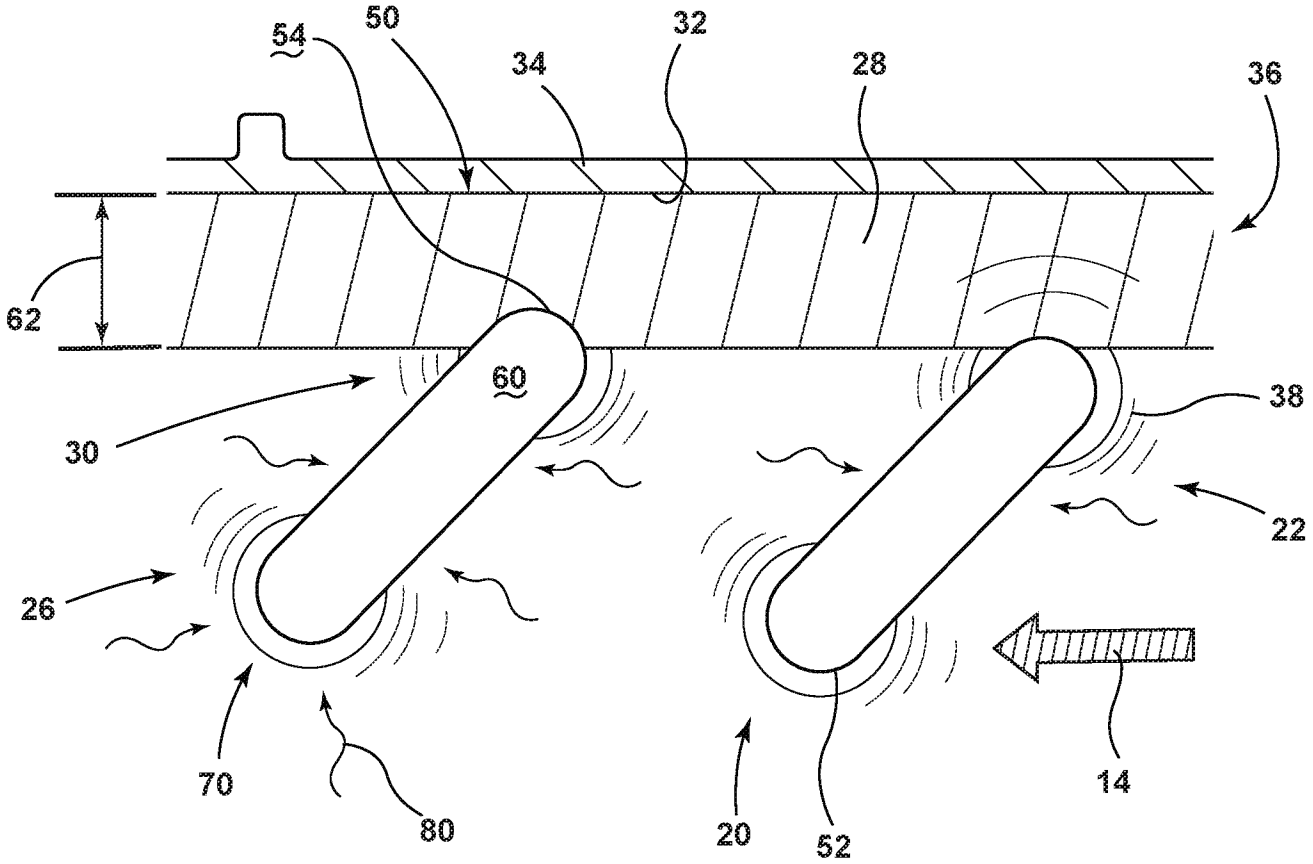
FIG. 6 is an enlarged cross-sectional view of the appliance basement of FIG. 5 taken at area VI.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As exemplified in FIGS. 1-6, reference numeral 10 generally refers to a heat pump system that is incorporated within a laundry appliance 12. The heat pump system 10 is configured to treat process air 14 that is moved through the appliance 12 for processing laundry disposed within a rotating drum 16 of the appliance 12. Process air 14 is moved from the rotating drum 16 and typically carries lint particles 18 and moisture from the rotating drum 16 toward the various heat exchangers 20 of the heat pump system 10. The heat exchangers 20 treat the process air 14 to dehumidify and potentially heat the process air 14 to be returned to the rotating drum 16 to continue a particular drying operation.

Referring again to FIGS. 1-6, the laundry appliance 12 can include a rotating drum 16 for processing laundry. The heat pump system 10 includes the heat exchanger 20 that is positioned within an air conditioning chamber 22. A blower 24 is configured to direct process air 14 through an air path 26 that includes the rotating drum 16 and the air conditioning chamber 22. An insulating member 28 is positioned between a top portion 30 of the heat exchanger 20 and an underside 32 of a cover member 34 for the air conditioning chamber 22. The insulating member 28 is configured to direct the process air 14 through the heat exchanger 20 and away from the underside 32 of the cover member 34. In this manner, the insulating member 28 occupies substantially all of a space 36 that is defined between the top portion 30 of the heat exchanger 20 and the underside 32 of the cover member 34. Through use of the insulating member 28, the process air 14 can be directed or redirected toward the heat exchanger 20, thereby preventing the process air 14 from circumventing the heat exchanger 20 as it moves through the air conditioning chamber 22. The insulating member 28 also absorbs sound and vibration 38 generated by movement of process air 14 through the heat exchanger 20, as will be described more fully below.

Referring again to FIGS. 2-6, the insulating member 28 can be in the form of an acoustical damper 50 that absorbs sound and other vibration 38 generated by movement of the process air 14 through the heat exchanger 20. As the blower 24 operates, the process air 14 from the rotating drum 16 is moved through the air path 26 and into the air conditioning chamber 22 to be treated by the one or more heat exchangers 20 disposed therein. As the process air 14 moves through the heat exchangers 20, the force of the processed air may cause a certain amount of vibration 38 within the structures 52 of the heat exchanger 20. These vibrations 38 may result in sound. These vibrations 38 and sound emanating from the heat exchanger 20 can be substantially absorbed by the acoustical damper 50 that is positioned above the top portion 30 of the heat exchanger 20 and below the underside 32 of the cover member 34. As the process air 14 moves through the heat exchangers 20, small channels that may also be defined between fins of the heat exchanger 20 or the other structures 52 of the heat exchanger 20 may also result in whistling or other resonating frequencies when the process air 14 moves therethrough. These resonating frequencies and whistling can also be absorbed by the acoustical damper 50 that is placed within the air conditioning chamber 22.

According to various aspects of the device, the insulating member 28 can be secured within the space 36 defined between the heat exchanger 20 and the cover member 34 through an adhesive. In such an embodiment, the insulating member 28 can be adhered to the underside 32 of the cover member 34. Typically, the cover member 34 is a removable portion of the air conditioning chamber 22 that can be removed and replaced to allow for maintenance of the heat exchangers 20 and other structures 52 within and around the air conditioning chamber 22. As the cover member 34 is removed and replaced, the insulating member 28 that is adhered thereto remains coupled to the underside 32 of the cover member 34. When the cover member 34 is placed on the air conditioning chamber 22 and over the heat exchangers 20, the insulating member 28 can rest upon the top surface 54 of the heat exchanger 20.

In various embodiments of the device, the insulating member 28 can also be compressed between the top portion 30 of the heat exchanger 20 and the underside 32 of the cover member 34. In such an embodiment, the insulating member 28 has a shape that is larger than the space 36 between the top portion 30 of the heat exchanger 20 and the underside 32 of the cover member 34. When the cover member 34 is placed over the heat exchangers 20, the cover member 34 presses down on the insulating member 28 and biases the insulating member 28 against the top portion 30 of the heat exchanger 20. The insulating member 28 thereby forms around various structures 52 within the top portion 30 of the heat exchanger 20, such as tubes, fins, plates, and other similar structures 52. This compressive engagement defines a secure engagement between the heat exchanger 20, the insulating member 28 and the cover member 34.

To allow for the compression of the insulating member 28, the insulating member 28 may be any one of various compressible insulating materials. Such materials typically include various types of semi-closed-cell foam. Additionally, other types of insulating material can be used, where such insulating materials can include, but are not limited to, closed-cell foam, open-cell foam, fibrous insulation, batting-type insulation, insulating panels, spray-type insulation, combinations thereof, and other similar insulating materials.

Where the insulating material is compressed between the cover member 34 of the air conditioning chamber 22 and the top portion 30 of the heat exchanger 20, the insulating member 28, in the form of the acoustical damper 50, may also engage a side surface 60 of the heat exchanger 20. In such an embodiment, as the insulating member 28 is compressed onto the heat exchanger 20, portions of the insulating member 28 may be pressed or otherwise biased downward and around the top portion 30 of the heat exchanger 20 to engage side surfaces 60 of the heat exchanger 20.

In various aspects of the device, the insulating material can be a formable or partially elastic material that can be formed, contoured, cut, or otherwise manipulated to take the shape of the top portion 30 of the heat exchanger 20. In such an embodiment, the insulating member 28 conforms to the shape of the underside 32 of the cover member 34 and also substantially conforms to the shape of the top portion 30 of the heat exchanger 20. In the various embodiments of the device, one of the purposes of the insulating member 28 is to occupy the space 36 or gap 62 defined between the heat exchanger 20 and the cover member 34. In this manner, the insulating member 28 can absorb various vibrations 38 and noises emanating from the heat exchanger 20 as a result of the process air 14 passing therethrough.

Another function of the insulating member 28 is to occupy the space 36 that is defined between the heat exchanger 20 and the cover member 34 so that the process air 14 can be funneled through the heat exchanger 20. By moving substantially all of the process air 14 through the heat exchanger 20, the thermal exchange properties of the heat exchanger 20 can be maximized to act on substantially all of the process air 14 within the air conditioning chamber 22. With a minimal amount of air circumventing the heat exchanger 20, the heat exchange function of the heat pump system 10 can be made more efficient during various drying operations of the appliance 12.

In various aspects of the device, the heat exchanger 20 that is disposed within the air conditioning chamber 22 can include an evaporator 70 and a condenser 72. In such an embodiment, the insulating member 28 is configured to extend over each of the evaporator 70 and condenser 72 so that the insulating member 28 rests on or is compressed against top portions 30 of each of the evaporator 70 and condenser 72.

In various aspects, the evaporator 70 and condenser 72 may be disposed within separate and dedicated air conditioning chambers 22 that are each part of the air path 26 of the appliance 12. Additionally, multiple condensers 72 may be included within the appliance 12 where one condenser 72 may be a primary condensing heat exchanger 20 and a secondary condenser 72 may be in the form of a refrigerant sub-cooler. In such an embodiment, various insulating members 28 can be disposed on top of the heat exchangers 20 and below the respective cover members 34 to absorb sound and vibration 38 that may be generated by the movement of process air 14 through the various heat exchangers 20.

Referring again to FIGS. 2-6, during operation of the appliance 12 and in particular operation of the heat pump system 10, various thermal exchange functions are performed by the evaporator 70 and the condenser 72 of the heat pump system 10. In the case of the evaporator 70, the evaporator 70 dehumidifies the process air 14 delivered from the rotating drum 16. Through this dehumidification of the process air 14, condensate is removed from the process air 14. This condensate can collect on the outer surface of the evaporator 70. To prevent this condensate from absorbing into the insulating member 28, the insulating member 28 is typically made of a hydrophobic material that resists absorption of this condensate into the material of the insulating member 28. Accordingly, the condensate generated by the evaporator 70 can be moved to a drain channel or other condensate collection area 74 in another portion of the appliance 12. Additionally, any condensate that may collect on a surface of the insulating member 28 can also drip off into this condensate collection area 74 rather than be absorbed into the insulating member 28.

The insulating member 28 can also act as a thermal barrier having various thermal insulating properties. These thermal insulating properties prevent thermal transmission of heat 80 between the insulating member 28 and the evaporator 70 and condenser 72 of the heat pump system 10. Accordingly, as the evaporator 70 of the heat pump system 10 operates, heat 80 is absorbed from areas around the heat exchanger 20. By absorbing heat 80 around the evaporator 70, the temperature of areas around the evaporator 70 are decreased, resulting in dehumidification of the process air 14 moving through the evaporator 70. Because the insulating member 28 is a thermal barrier having thermally insulating properties, minimal amounts of heat 80 are absorbed from the insulating member 28 or through the insulating member 28. Accordingly, the absorption of heat 80 is configured to take place within the immediate area surrounding the evaporator 70.

This thermally insulating property of the insulating member 28 serves to make the evaporator 70 more efficient by absorbing heat 80 from process air 14 as opposed to areas within or above the insulating member 28.

With respect to the condenser 72, these thermally insulating properties of the insulating member 28 serve to resist heat 80 rejected from the condenser 72 from entering into and/or passing through the insulating member 28. As with the evaporator 70, the insulating member 28 allows for the condenser 72 to heat process air 14 in the area immediately surrounding and within the condenser 72, rather than heating areas within and above the insulating member 28.

Referring again to FIGS. 1-6, a heat exchange system for the appliance 12 having a heat pump system 10 can include the blower 24 that directs process air 14 through the air path 26 that includes the rotating drum 16. The heat pump system 10 includes the evaporator 70 positioned within the air path 26 for dehumidifying the process air 14. A top portion 30 of the evaporator 70 is separated from an inside surface of the air path 26 by a gap 62. The insulating member 28 is positioned to occupy the gap 62 and engage the top portion 30 of the heat exchanger 20 as well as the inside surface of the air path 26. In this manner, the insulating member 28 directs the process air 14 away from the gap 62 and into the evaporator 70. Additionally, the insulating member 28 absorbs sound generated by movement of the process air 14 through the evaporator 70.

As discussed above, the evaporator 70 can be positioned within the air conditioning chamber 22 of the air path 26. In such an embodiment, the gap 62 is located between the top portion 30 of the evaporator 70 and the cover member 34 of the air conditioning chamber 22.

Referring again to FIGS. 2-6, the condenser 72 of the heat pump system 10 that serves to heat the process air 14 within the air path 26 is typically disposed at a position downstream of the evaporator 70. Typically, a portion of the insulating member 28 extends over the condenser 72 to direct process air 14 into the condenser 72 and also to absorb sound and vibration 38 generated by movement of the process air 14 through the condenser 72. As discussed previously, the condenser 72 is typically located within the air conditioning chamber 22 and is connected to the evaporator 70. In such an embodiment, the insulating member 28 extends continuously over the evaporator 70 and the condenser 72 to occupy the gap 62 that is defined between the top portion 30 of the evaporator 70 and the underside 32 of the cover member 34 and also between the top portion 30 of the condenser 72 and an underside 32 of the cover member 34.

The insulating member 28 can be retained within the gap 62 through various configurations and mechanisms. In at least one aspect of the device, the insulating member 28 can be adhered to the underside 32 of the cover member 34 and the insulating member 28 occupies the gap 62 defined between the heat exchangers 20 (the evaporator 70 and the condenser 72) and the cover member 34. The insulating member 28 can also be compressed between the underside 32 of the cover member 34 and the top surface 54 of the evaporator 70 and the top surface 54 of the condenser 72. As described above, the insulating member 28 can typically be in the form of an acoustical damper 50 that absorbs sound generated by movement of the process air 14 through the evaporator 70 and the condenser 72. By having the insulating member 28 occupy the entire gap 62 between the cover member 34 and the evaporator 70 and condenser 72, the insulating member 28 can absorb vibration 38, resonance, sound, and other frequencies generated through operation of the heat pump system 10 and also through the passage of process air 14 through the evaporator 70 and condenser 72.

Referring again to FIGS. 1-6, the heat exchange system for the heat pump appliance 12 can include a blower 24 that directs process air 14 through the air path 26 and includes the rotating drum 16 and a heat exchange cavity 90. According to various aspects of the device, the heat exchange cavity 90 can be defined within the air conditioning chamber 22 having the cover member 34. The heat pump system 10 for the appliance 12 includes the evaporator 70 and a condenser 72 that are positioned within the heat exchange cavity 90 for dehumidifying and heating the process air 14, respectively. An acoustical damper 50 can be compressed between the top surfaces 54 of the evaporator 70 and the condenser 72, and an interior surface of the heat exchange cavity 90. In such an embodiment, the acoustical member directs the process air 14 away from the gap 62 and into the evaporator 70 and condenser 72, and also absorbs sound generated by the movement of process air 14 through the evaporator 70 and condenser 72. According to various aspects of the device, the acoustical member can be in the form of a semi-closed-cell foam that is disposed within the gap 62.

According to various aspects of the device, the insulating member 28 can be disposed within the various heat pump systems 10 for a wide range of appliances 12. Such appliances 12 can include, but are not limited to, dryers, combination washers and dryers, refrigerators, coolers, freezers, air conditioners, humidity-controlling appliances, and other similar appliances.

The use of the insulating member 28 can include single pieces that are disposed over each heat exchanger 20 of the heat pump system 10 separately. Additionally, the insulating member 28 can be a continuous piece that is disposed over multiple heat exchangers 20 within the heat pump system 10. Typically, where multiple heat exchangers 20 are included within a single heat exchange cavity 90, the heat exchange cavity 90 will include a single insulating member 28. Where multiple heat exchangers 20 are disposed in separate and dedicated cavities, each of these dedicated cavities will typically have a separate insulating member 28 disposed between the top surface 54 of the respective heat exchanger 20 and the cover member 34 for the particular heat exchange cavity 90.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures 52, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures 52 and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A laundry appliance comprising:

a rotating drum for processing laundry;

a heat pump system having a heat exchanger that is positioned within an air conditioning chamber;

a blower that directs process air through an air path that includes the rotating drum and the air conditioning chamber, the heat exchanger having a plurality of heat exchange tubes that engage the process air within the air conditioning chamber; and an insulating member positioned between a top portion of the heat exchanger and an underside of a cover member for the air conditioning chamber, the insulating member extending partially around at least one tube of the plurality of heat exchange tubes, wherein a portion of the at least one tube opposite the insulating member is exposed to the process air, wherein the insulating member directs the process air through the heat exchanger and away from the underside of the cover member and absorbs sound and vibration generated by movement of the process air through the heat exchanger.

2. The laundry appliance of claim 1, wherein the insulating member occupies substantially all of a space defined between the top portion of the heat exchanger and the underside of the cover member, wherein the top portion of the heat exchanger includes a top surface of the at least one tube of the plurality of heat exchange tubes.

3. The laundry appliance of claim 1, wherein the insulating member is a semi-closed-cell foam.

4. The laundry appliance of claim 1, wherein the insulating member is adhered to the underside of the cover member and compresses against a top surface of the at least one tube.

5. The laundry appliance of claim 1, wherein the heat exchanger includes an evaporator and a condenser, wherein the insulating member extends over each of the evaporator and the condenser.

6. The laundry appliance of claim 1, wherein the insulating member is an acoustical damper that absorbs sound generated by movement of the process air through the heat exchanger.

7. The laundry appliance of claim 1, wherein the insulating member engages a side surface of the heat exchanger.

8. The laundry appliance of claim 1, wherein the insulating member is made of a hydrophobic material.

9. The laundry appliance of claim 1, wherein the cover member is a separate piece that is coupled with the air conditioning chamber.

10. The laundry appliance of claim 1, wherein the insulating member is compressed between the top portion of the heat exchanger and the underside of the cover member.

11. The laundry appliance of claim 1, wherein the insulating member is a thermal barrier that limits thermal transmission between the heat exchanger and the underside of the cover member.

12. A heat exchange system for a heat pump appliance, the heat exchange system comprising:

a blower that directs process air through an air path that includes a rotating drum;

a heat pump system having an evaporator positioned within the air path for dehumidifying the process air, wherein a top portion of the evaporator is separated from an inside surface of the air path by a gap; and an insulating member that occupies the gap and engages the top portion of the evaporator and the inside surface of the air path, wherein the insulating member partially encircles a tube of the evaporator to partially form around the tube, wherein the insulating member directs the process air away from the gap and into the evaporator, and wherein a portion of the tube opposite the insulating member is exposed to the air path and the process air.

13. The heat exchange system of claim 12, wherein the evaporator is positioned within an air conditioning chamber of the air path, wherein the gap is located between the top portion of the evaporator and a cover member of the air conditioning chamber.

14. The heat exchange system of claim 13, further comprising:

a condenser of the heat pump system that heats the process air within the air path at a position downstream of the evaporator, wherein a portion of the insulating member extends over the condenser to direct the process air into the condenser.

15. The heat exchange system of claim 14, wherein the condenser is located within the air conditioning chamber and the insulating member extends continuously over the evaporator and the condenser to occupy the gap that is between the top portion of the evaporator and the cover member and also between a top portion of the condenser and the cover member.

16. The heat exchange system of claim 14, wherein the insulating member is an acoustical damper that absorbs sound generated by movement of the process air through the evaporator and the condenser.

17. The heat exchange system of claim 14, wherein the insulating member is compressed between an underside of the cover member and a top surface of the evaporator and a top surface of the condenser.

18. A heat exchange system for a heat pump appliance, the heat exchange system comprising:

a blower that directs process air through an air path that includes a rotating drum and a heat exchange cavity;

a heat pump system having an evaporator and a condenser positioned within the heat exchange cavity for dehumidifying and heating the process air, respectively; and an acoustical damper that is compressed within a gap defined between top surfaces of the evaporator and the condenser and an interior surface of the heat exchange cavity, wherein the acoustical damper is compressed to partially extend around a portion of a coolant tube of the evaporator to direct the process air away from the gap and into the evaporator and also absorbs sound generated by movement of the process air through the evaporator and the condenser, wherein a surface of the coolant tube opposite the portion against which the acoustical damper is compressed is exposed to the air path and the process air.

19. The heat exchange system of claim 18, wherein the heat exchange cavity is defined within an air conditioning chamber having a cover member and wherein the acoustical damper is adhered to an underside of the cover member.

20. The heat exchange system of claim 18, wherein the acoustical damper is a semi-closed-cell foam.

* * * * *